United States Patent [19]

Doty

[11] 3,999,304

[45] Dec. 28, 1976

[54] CLOTHES DRYER FILTER AND EXHAUST SYSTEM

[76] Inventor: Edward E. Doty, 6425 Smoke Rise Trail, Flint, Mich. 48507

[22] Filed: July 18, 1975

[21] Appl. No.: 597,303

[52] U.S. Cl. ..... 34/82; 34/86; 34/90; 55/511; 55/485

[51] Int. Cl.[2] ..... F26B 21/06

[58] Field of Search ..... 34/82, 80, 133, 90, 34/91, 86; 55/503, 504, 511, 415, 485

[56] References Cited

UNITED STATES PATENTS

| | | | |
|---|---|---|---|
| 3,171,428 | 3/1965 | Bozeman | 34/90 |
| 3,417,481 | 12/1968 | Rumsey, Jr. | 34/90 |
| 3,487,624 | 1/1970 | Tignanelli | 34/82 |
| 3,520,110 | 7/1970 | Knaver | 55/511 |
| 3,878,621 | 4/1975 | Duerre | 34/90 |

*Primary Examiner*—Kenneth W. Sprague
*Assistant Examiner*—James C. Yeung
*Attorney, Agent, or Firm*—Harry R. Dumont

[57] ABSTRACT

A portable filter enclosure is connected to the exhaust outlet for a clothes dryer. The enclosure includes a multiple stage successive filter screen arrangement for removing entrained particles or lint from the air stream from the dryer. The enclosure is coupled through a flexible coupling to the exhaust outlet of the dryer to permit the exhausted heat to be directed at will to any part of the room or rooms near the dryer. Further included is a louvered arrangement in the outlet of the enclosure which permits further adjustment of the air stream. The outlet of the enclosure has a shape which is adapted to allow for connection of a hand-held drying tool or the like which may then be connected to utilize the output of the warm air from the dryer.

5 Claims, 3 Drawing Figures

CLOTHES DRYER FILTER AND EXHAUST SYSTEM

FIELD OF THE INVENTION

The present invention relates to an improved multiple purpose filter enclosure, associated structure and adjunct for use in conjunction with clothes dryers of either the electrically heated or gas heated type.

BACKGROUND OF THE INVENTION

In the conventional clothes dryer, air is heated by either electric or gas elements and circulated through a drum in which damp clothes are rotatably held. The drying and tumbling of the clothes frees a large quantity of lint from the clothes, which is carried from the dryer unit by its exhaust vent. The lint which is typically carried out by the warm air from the dryer is either exhausted through a duct connection to the outside of the house generally through an open port arrangement or it is deposited within some type of a filter screen arrangement incorporated within the dryer itself. Initially, screen type filters generally of a single screen type were incorporated in the dryer unit which provided improvement as compared to having no filter at all. Such filters did not remove lint efficiently so that the basic problem of lint being carried out by the exhausted air from the dryer remained.

The problem was generally resolved by removing the lint by venting all of the warm air stream from the dryer to the outside of the house through a port. This resulted in considerable heat loss since the warm air is immediately lost to the outside atmosphere. This causes a particular disadvantage in colder climates in which it would be far preferable to direct the warm air to the utility room or, alternately, to the basement room in which the dryer might be located to assist in heating these rooms and in making them more usable.

The present invention makes it possible to improve the degree of filtration of lint and entrained particles from the exhausted air. At the same time, it provides a connection and arrangement of parts in the filter enclosure so that the warm air stream which it handles from the dryer may be selectively directed, for example, toward an outside wall of the room. In a further embodiment of the invention, the outlet element from the filter enclosure is shaped and designed to receive a coupling and a handheld hair dryer which can utilize the warm air exhausted from the system and provide a rapid stream of easily controllable warm air for the purpose.

The system thus is designed to utilize and make the fullest possible use of virtually all of the heat generated in the dryer system and to in this manner reduce overall energy requirements in the household. The filter enclosure further operates as a means for restoring humidity to the air in the building since an amount of moisture is entrained in the warm air stream from the dryer. By reason of the mode of construction and connection of the filter enclosure unit, when it is actually desired to direct the warm air away from the room, for example, in mid-summer, it is possible to place the enclosure unit and direct its exhaust warm air stream through a louvered arrangement so that the warm air for the period desired is vented out an open window to the outside atmosphere.

SUMMARY OF THE PRESENT INVENTION

The present invention thus provides a unique type of filter enclosure unit and arrangement which provides the filtering of exhaust air from the dryer and still further adapts it for use not only in heating the room in which the dryer is located when desired but also in using it for hand-held instruments, such as hair dryers, to make a still further utilization of the exhaust air stream and the heat contained therein.

BRIEF DESCRIPTION OF THE DRAWINGS

Reference is made to the accompanying drawings in which like numerals refer to like parts throughout the different views, and in which.

DETAILED DESCRIPTION OF THE PREFERRED EMBODIMENT

Figure 1:
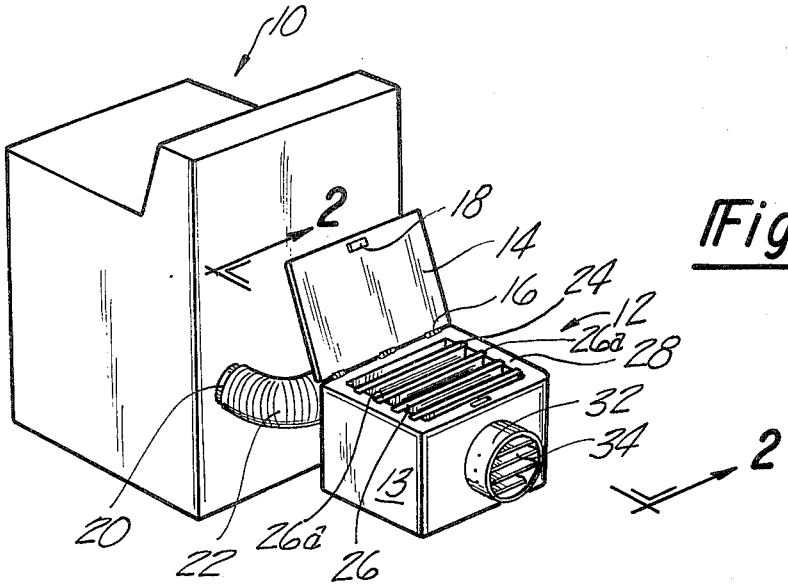
FIG. 1 is a perspective view showing the filter enclosure as it is connected and used in conjunction with a conventional clothes dryer.

Referring now to FIG. 1 of the drawings, the numeral 10 generally designates a conventional clothes dryer and the numeral 12 generally designates the filter enclosure of the present invention used along with the dryer. The filter enclosure 12 includes a lid 14 connected to the upper part of the enclosure 12 and shown in its open position. The lid 14 is hinged at its lower edge by hinges 16 and includes a latch 18 which is operable to hold it in the closed or operating position of the filter enclosure 12. It will also be seen that the filter enclosure 12 is connected to the exhaust output 20 of the dryer 10 through a flexible hose coupling 22. This allows for free movement of the filter enclosure 12 in such position as is desired to direct the heat output of the air stream passing through it.

It will further be seen that there are included within the filter enclosure 12 a plurality of filter stages 24, four in number. Each of the different filter stages 24 comprises a filter of the slidable type, movable vertically relative to the enclosure 12 so that it may be readily lifted out, inspected cleaned and reinserted. To allow for this ready removal and insertion, each such filter stage 24 includes a frame 26 having a slidable narrowed edge portion 26a formed in particular along the vertical margin of each such frame. Each frame 25 is thus vertically movable in a complementary cut-out portion 28 formed in the sidewalls 13 of the enclosure 12. This construction is best shown in the FIG. 1 drawing.

Figure 2:
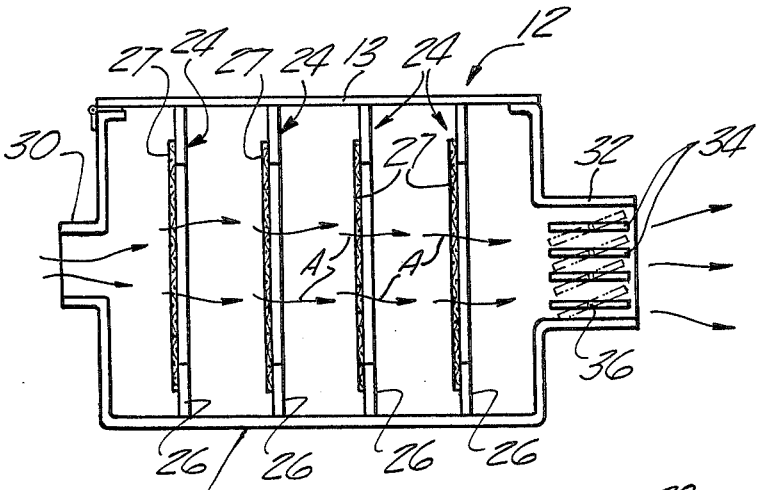
FIG. 2 is a sectional view along the lines 2–2 of FIG. 1 showing the internal construction of the filter enclosure and its arrangement of separate filter elements.

FIG. 2 shows further detail of the enclosure unit 12. Included at the left hand side is an inlet 30. Included at the right hand side is an outlet 32. The inlet 30 is of a cylindrical configuration, adapted to receive the end of flexible hose coupling 22 in tight engagement. The outlet 32 is likewise of a cylindrical shape and has mounted therein a pivotal set of louvers 34 which may be tilted about their central pivotal axes 36 thus to direct the exiting air stream in the particular direction desired.

The structural details of the successive filter stages 24 are likewise shown in FIG. 2. In each case, the frame 26 has mounted thereon a filter screen 27 through which the exiting air flow passes as shown by arrows A. It will further be seen that in each successive filter stage 24 the mesh of the screen 27 becomes finer. Each successive filter element 27 having a finer mesh insures that any lint that might have passed the primary or first left hand filter element 27 will be removed from the air. The decreasing mesh and particle entrapping size and the rectangular cross-sectional area of each successive filter element 24 insures that virtually any lint which is small enough to have gotten past the first element will be finally trapped before it is passed out to the enclosure outlet 32. The hinged lid arrangement for the enclosure 12 makes possible the ready opening of lid 14 and then the removal and cleaning of those individual ones of the filter stages 24 for which cleaning is required.

Substantial advantages arise from the flexible hose coupling through hose 22. This permits the positioning of the enclosure unit 12 to a remote part of the room for heating, or perhaps around a corner to direct a warm air stream into a corridor or adjacent room in the dwelling.

Figure 3:
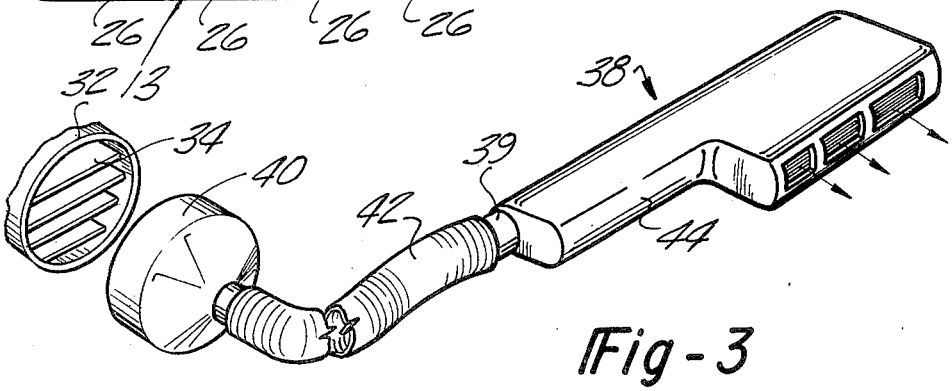
FIG. 3 is a further perspective view of a hand-held hair dryer which may be installed and used along with the filter enclosure of FIGS. 1 and 2.

FIG. 3 shows a further embodiment of the invention in which there is coupled to the outlet 32 of the filter enclosure 12 a hand-held device 38 which is adapted for hair drying or indeed any operation in which a movable warm air stream is required. It will be understood that while the embodiment shown by FIG. 3 relates to the use of a hand-held hair drying adjunct, the invention is not so limited and might be used to handle any drying operation, for example, paint drying or the like, where localized warm air streams are required. With more particular attention now to the FIG. 3 showing, there is included associated with the hand-held device 38 a cup adapter 40 which is of a size to provide a press-fit over the outlet 32. The hand-held device 38 has its inlet 39 connected again through a flexible, spiral round hose 42 to the end of the cup 40. It will be understood that the handle portion 44 is then used to again in a more precise manner direct the exiting air stream toward the hair of the user or in the performance of other small drying operations.

The filter enclosure system provided by the present invention will thus be seen to perform a number of important added functions, such as providing a selective heating system usable in the room in which the dryer is located and further providing a highly selective and precisely directable warm air stream arrangement for hair drying or the like. The fullest conservation and useful employment of the energy already involved in the clothes dryer system is thus made possible.

What is claimed is:

1. An exhaust system for a clothes dryer having extending therefrom an exhaust outlet for directing flow of heated air therefrom after its use in the dryer, comprising:

a portable filter enclosure, said filter enclosure further having an inlet and an outlet;

a flexible hose coupling intermediate said exhaust outlet of said dryer and said inlet of said filter enclosure, said outlet of said filter enclosure further including flow directional control means displaceable to direct the stream of air from the dryer in a desired course; said filter enclosure further including a pivotal lid, a multiple stage filter mounted in said enclosure and accessible responsive to lifting of the lid to a pivoted open condition, each of said filter stages comprising a slidable filter element, movable vertically relative to said enclosure for ready removal, cleaning and reinsertion.

2. The combination as set forth in claim 1 wherein each of said successive filters in said multiple stages has a progressively finer mesh element to facilitate removal of entrained particles in the air stream from said dryer.

3. The combination as set forth in claim 1 wherein each of said filters includes a frame, each frame having a narrow edge portion formed along a vertical margin of each side, said portion being slidably engageable within a respective slot portion formed in the opposed sidewall of said enclosure.

4. The combination as set forth in claim 1 wherein there is further connected to the outlet of said enclosure proximate its louvered exit port a hand held device for directing air streams for hair drying.

5. The combination as set forth in claim 4 including a sleeve engageable tightly over said outlet of said filter enclosure and a spiral round type flexible hose connected therebetween and in communication with the inlet for said device.

* * * * *